US012162646B2

(12) United States Patent
Yun et al.

(10) Patent No.: US 12,162,646 B2
(45) Date of Patent: Dec. 10, 2024

(54) DISPLAY DEVICE PACKAGING BOX

(71) Applicant: Samsung Display Co., LTD., Yongin-si (KR)

(72) Inventors: Su-Young Yun, Yongin-si (KR); Sung Jin Joo, Yongin-si (KR); Ja Huem Koo, Yongin-si (KR); Jin-Wook Cho, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 10 days.

(21) Appl. No.: 18/093,038

(22) Filed: Jan. 4, 2023

(65) Prior Publication Data

US 2023/0339652 A1 Oct. 26, 2023

(30) Foreign Application Priority Data

Apr. 26, 2022 (KR) ..... 10-2022-0051672

(51) Int. Cl.
*B65D 85/30* (2006.01)
*B65D 25/10* (2006.01)
*B65D 81/02* (2006.01)

(52) U.S. Cl.
CPC ..... *B65D 25/107* (2013.01); *B65D 81/022* (2013.01); *B65D 85/30* (2013.01); *B65D 2581/055* (2013.01); *B65D 2585/86* (2013.01)

(58) Field of Classification Search
CPC .... B65D 25/107; B65D 81/022; B65D 81/05; B65D 85/30; B65D 85/48; B65D 2581/055; B65D 2585/86; H01L 21/67386; H01L 21/67369; H01L 21/6734
USPC ..... 206/454, 587; 220/533
See application file for complete search history.

(56) References Cited

U.S. PATENT DOCUMENTS 8,453,841 B1 * 6/2013 James ..... H01L 21/67326 206/711
2015/0210457 A1 * 7/2015 DiMauro ..... B65B 61/207 53/472
2017/0172000 A1 * 6/2017 Koo ..... B65D 25/107

FOREIGN PATENT DOCUMENTS

KR 10-0621467 9/2006
KR 10-1385953 4/2014
KR 10-1571158 12/2015
KR 10-1617275 5/2016

* cited by examiner

*Primary Examiner* — King M Chu
(74) *Attorney, Agent, or Firm* — KILE PARK REED & HOUTTEMAN PLLC

(57) ABSTRACT

A packing box according to an embodiment includes a lower body including a bottom portion and a lower wall portion extending upward from the bottom portion; and an upper body including a cover portion and an upper wall portion extending downward from the cover portion defining an inner space with the lower body in case that combined with the lower body. The upper wall portion includes at least one groove in which an edge portion of a display device is inserted, and the cover portion includes at least one opening abutting with the at least one groove.

20 Claims, 15 Drawing Sheets

DISPLAY DEVICE PACKAGING BOX

CROSS-REFERENCE TO RELATED APPLICATION(S)

This application claims priority to and benefits of Korean Patent Application No. 10-2022-0051672 under 35 U.S.C. § 119 filed in the Korean Intellectual Property Office on Apr. 26, 2022, the entire contents of which are incorporated herein by reference.

BACKGROUND

1. Technical Field

This disclosure relates to a packing box and to a packaging box that can be used to load and transport a display device.

2. Description of the Related Art

Display devices such as emissive display devices and liquid crystal displays (LCDs) are used to display images in electronic products such as monitors, televisions, and tablets. A display device can be loaded into a packaging box and transported to a set maker or set assemble line, and assembled with other parts at a set maker or set assemble line can be manufactured into electronic products sold to general consumers.

The above information disclosed in this background section is only for enhancement of understanding of the background, and therefore it may contain information that does not form the prior art that may already be known to a person of ordinary skill in the art.

SUMMARY

In the process of being loaded into a packaging box and transported, a display device may move in the packaging box by vibration or impact, and thus the display device may be damaged.

Embodiments are to provide a packing box that can prevent damage to a display device.

A packing box according to an embodiment may include a lower body including a bottom portion and a lower wall portion extending upward from the bottom portion; and an upper body including a cover portion and an upper wall portion extending downward from the cover portion and defining an inner space with the lower body in case that combined with the lower body. The upper wall portion includes at least one groove in which an edge portion of a display device is inserted, and the cover portion includes at least one opening abutted with the at least one groove.

The at least one opening may penetrate the cover portion and extend up to the upper wall portion of the upper body.

A lower end portion of the at least one opening may abut an upper end portion of the at least one groove.

The at least one opening may be shifted in a horizontal direction from the at least one groove.

The at least one opening may not overlap the at least one groove in plan view.

The upper wall portion may include a rib adjacent to the at least one groove, and the at least one opening may overlap the rib in plan view.

The upper wall portion may include a first upper wall portion and a second upper wall portion facing each other, the at least one groove may include grooves in inner surfaces of the first upper wall portion and second upper wall portion, and the at least one opening may include openings corresponding to the grooves.

The openings may be formed in a line on both sides of the cover portion corresponding to the first upper wall portion and the second upper wall portion.

The at least one opening may have a substantially trapezoidal planar shape.

The packing box may further include isolation portions protruding downward from the cover portion and defining a slot into which the edge portion of the display device is inserted; and a pad disposed between the upper wall portion and the isolation portions and contacting the edge portion of the display device.

The isolation portions may be formed in rows. The packing box may include a pad disposed between adjacent rows of isolation portions and contacting the edge portion of the display device.

The display device may be inserted into the at least one groove such that a screen faces the at least one opening.

The at least one groove may include grooves formed in plural on an inner surface of the upper wall portion, and the at least one opening may be formed corresponding to the grooves.

A packing box according to an embodiment may include a lower body on which a display device is loaded; and an upper body detachably connected with the lower body, The upper body may include a cover portion and an upper wall portion connected to the cover portion, and the upper wall portion may include a first upper wall portion and a second upper wall portion facing each other. The first upper wall portion and the second upper wall portion may be formed with grooves into which edge portions of the display device are inserted, and openings respectively abutted with the grooves may be formed in the cover portion of the upper body.

The openings may extend through the cover portion to the first upper wall portion and to the second upper wall portion.

Upper ends of the grooves and lower ends of the openings may be opened to each other.

The openings may be shifted in a horizontal direction from the grooves.

The first upper wall portion and the second upper wall portion may be formed with ribs disposed between the grooves, and the openings may overlap the ribs in plan view and may not overlap the grooves in plan view.

The openings may be formed in a line on both sides of the cover portion corresponding to the first upper wall portion and the second upper wall portion.

The packing box may further include isolation portions protruding downward from the cover portion and defining a slot into which an edge portion of the display device is inserted; and a pad disposed between the upper wall portion and the isolation portions and contacting the edge portion of the display device.

According to embodiments, it is possible to provide packing box that can prevent damage to the display device even though the display device moves within the packaging box. By way of example, although the display device is shaken by vibration or external impact during transportation of the display device, the side seal formed around the edge of the display panel can be prevented from being cracked. According to embodiments, there is an advantageous effect that can be recognized throughout the specification.

BRIEF DESCRIPTION OF THE DRAWINGS

The above and other aspects and features of the disclosure will become more apparent by describing in detail embodiments thereof with reference to the attached drawings, in which.

DETAILED DESCRIPTION OF THE EMBODIMENTS

Figure 1:
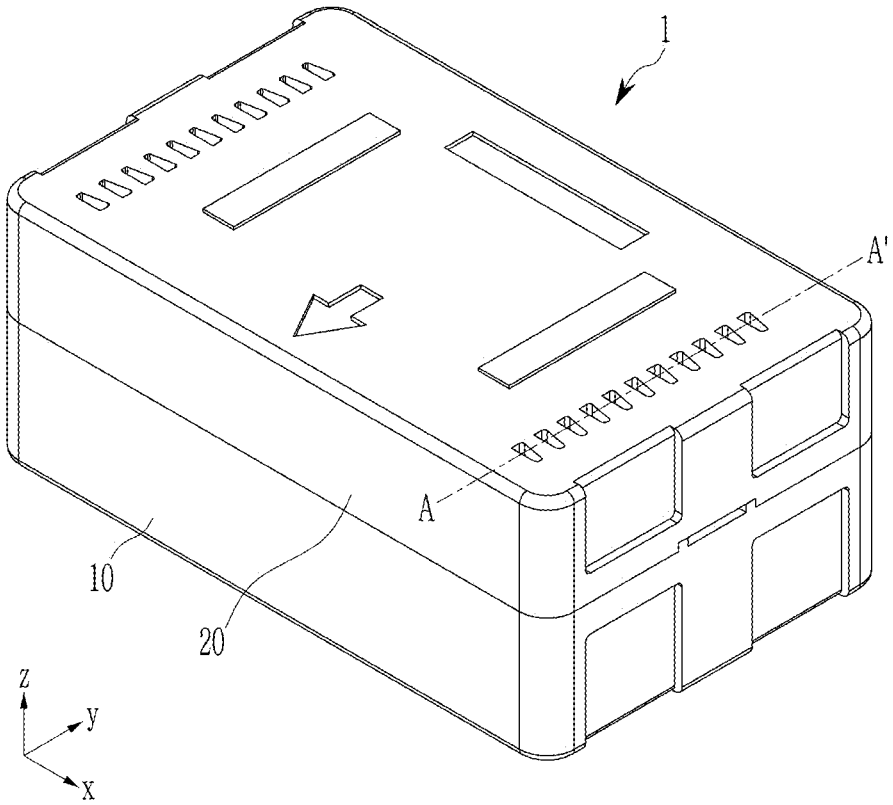
FIG. 1 is a schematic perspective view of packing box according to an embodiment.

With reference to the accompanying drawings, this disclosure will be described in detail so that a person of ordinary skill can readily implement the disclosure.

In the drawings, sizes, thicknesses, ratios, and dimensions of the elements may be exaggerated for ease of description and for clarity. Like numbers refer to like elements throughout.

As used herein, the singular forms, "a," "an," and "the" are intended to include the plural forms as well, unless the context clearly indicates otherwise.

In the specification and the claims, the term "and/or" is intended to include any combination of the terms "and" and "or" for the purpose of its meaning and interpretation. For example, "A and/or B" may be understood to mean "A, B, or A and B." The terms "and" and "or" may be used in the conjunctive or disjunctive sense and may be understood to be equivalent to "and/or."

In the specification and the claims, the phrase "at least one of" is intended to include the meaning of "at least one selected from the group of" for the purpose of its meaning and interpretation. For example, "at least one of A and B" may be understood to mean "A, B, or A and B."

It will be understood that, although the terms first, second, etc., may be used herein to describe various elements, these elements should not be limited by these terms. These terms are only used to distinguish one element from another element. For example, a first element may be referred to as a second element, and similarly, a second element may be referred to as a first element without departing from the scope of the disclosure.

When a part of a layer, film, region, plate, and the like is described to be "on" or "above" another part, it includes not only the case where it is "directly on" another component, but also the case where there is another component or components in between. Conversely, when a component is "right above" another, it means that there are no other components in between.

The terms "overlap" or "overlapped" mean that a first object may be above or below or to a side of a second object, and vice versa. Additionally, the term "overlap" may include layer, stack, face or facing, extending over, covering, or partly covering or any other suitable term as would be appreciated and understood by those of ordinary skill in the art.

When an element is described as 'not overlapping' or 'to not overlap' another element, this may include that the elements are spaced apart from each other, offset from each other, or set aside from each other or any other suitable term as would be appreciated and understood by those of ordinary skill in the art.

The terms "face" and "facing" mean that a first element may directly or indirectly oppose a second element. In a case in which a third element intervenes between the first and second element, the first and second element may be understood as being indirectly opposed to one another, although still facing each other.

The terms "comprises," "comprising," "includes," and/or "including,", "has," "have," and/or "having," and variations thereof when used in this specification, specify the presence of stated features, integers, steps, operations, elements, components, and/or groups thereof, but do not preclude the presence or addition of one or more other features, integers, steps, operations, elements, components, and/or groups thereof.

Throughout the specification, "connected" does not mean only when two or more constituent elements are directly connected, but also when two or more constituent elements are indirectly connected through another constituent element or elements, or when physically connected or electrically connected, and it may include a case in which substantially integral parts are connected to each other although they are referred to by different names according to positions or functions.

In drawing, the signs "x", "y" and "z" are used to indicate directions, where "x" is a first direction, "y" is a second direction that is perpendicular to the first direction, and "z" is a third direction that is perpendicular to the first direction and the second direction but the disclosure is not limited thereto.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined or implied herein, all terms (including technical and scientific terms) used herein have the same meaning as commonly understood by one of ordinary skill in the art to which the disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
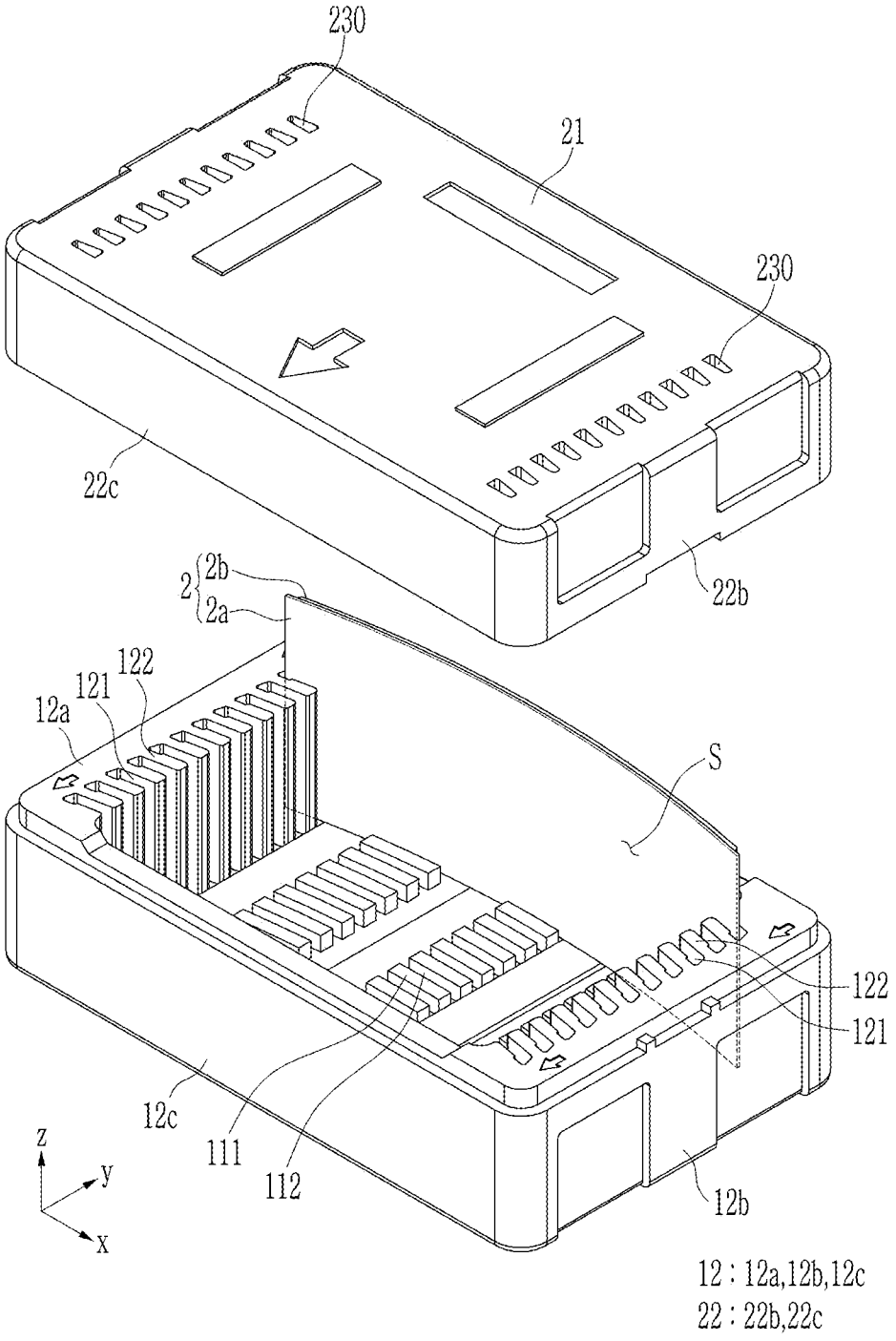
FIG. 2 and FIG. 3 are exploded perspective views of the display device packaging box according to an embodiment.
Figure 3:
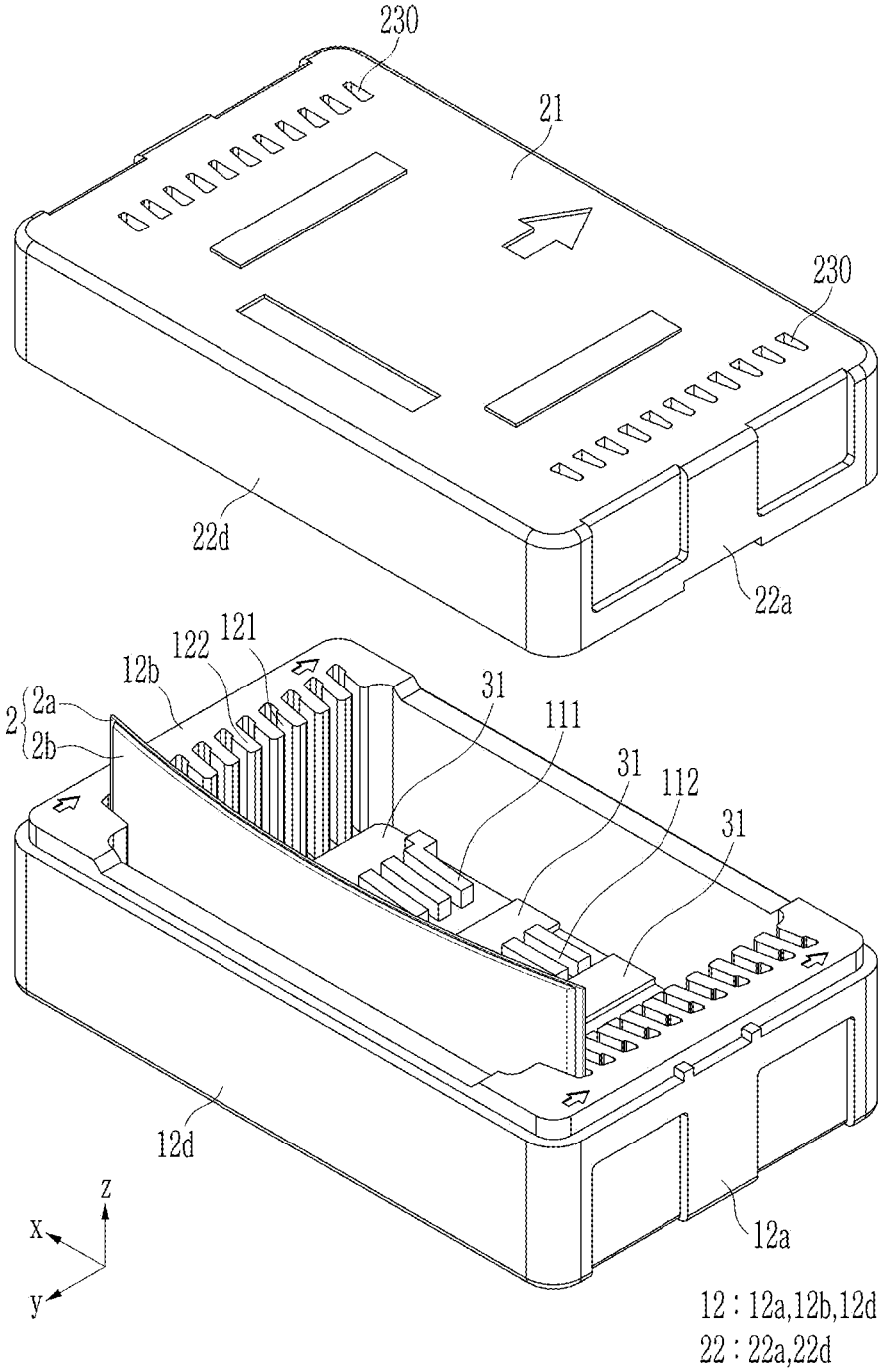
Figure 4:
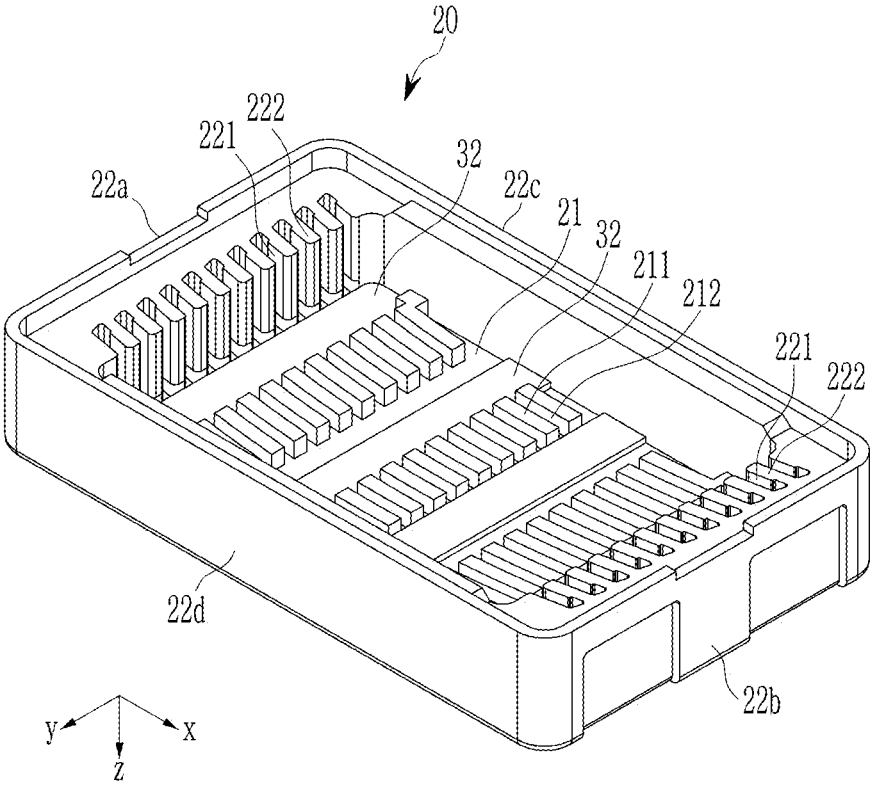
FIG. 4 is a schematic perspective view of an upper body of the display device packaging box according to an embodiment.

FIG. 1 is a schematic perspective view of packing box according to an embodiment, FIG. 2 and FIG. 3 are exploded perspective views of the display device packaging box according to an embodiment, and FIG. 4 is a schematic perspective view of an upper body of the display device packaging box according to an embodiment.

Referring to FIG. 1 to FIG. 4, packing box 1 (hereinafter, simply referred to as a packaging box) may have an approximately rectangular hexahedral shape as a whole. However, the disclosure is not limited thereto. The packaging box 1 may have a width in a first direction (x), a depth in a second direction (y), and a height in a third direction (z). The packaging box 1 may be used to load and transport a display device 2. The packaging box 1 may accommodate display devices 2 therein to protect the display device 2 from external environment and impact. The display device 2 may be loaded into the packaging box 1 in an upright state. In display device 2, a screen S on which an image is displayed is approximately vertical to the x-y plane, and may be stacked approximately parallel to the x-z plane.

Although one display device 2 is shown, the display devices 2 may be stacked in the packaging box 1. In the illustrated embodiment, a maximum of eleven display devices 2 can be loaded in packaging box 1. The display device 2 may include a display panel 2*a*, a chassis 2*b*, and the like within the spirit and the scope of the disclosure. The display panel 2*a* may have a thin rectangular plate shape as a whole, and may provide a screen S that displays images. The display panel 2*a* may be a liquid crystal panel or a light emitting display panel, but is not limited thereto. A liquid crystal panel may have a circuit layer and a liquid crystal layer positioned between two substrates. A light emitting display panel may have a circuit layer and light emitting diodes positioned between two substrates. The chassis 2*b* may be positioned on the rear side of the display panel 2*a*. The chassis 2*b* protects the display panel 2*a* and may serve as a support plate for fixing various components constituting the display device 2. The chassis 2*b* may include a metal or metal alloy, and may be made of stainless steel for example. The chassis 2*b* may be called a bottom chassis, a back chassis, or the like within the spirit and the scope of the disclosure. The display panel 2*a* and the chassis 2*b* may be connected by a bonding means such as double-sided adhesive tape. The display panel 2*a* and the chassis 2*b* may form a square plate shape as a whole in case that they are combined with each other. The display device 2 may include a circuit board (not shown) on which a driving circuit and a control circuit for driving the display panel 2*a* are disposed.

The display device 2 may be a curved display device in which the screen S is curved with a curvature radius with respect to an axis parallel to the third direction (z). The display device 2 may be curved as a whole. Unlike the illustration, the display device 2 may be entirely flat.

The packaging box 1 may include a lower body 10 (also referred to as first body) and an upper body 20 (or referred to as second body). The lower body 10 and the upper body 20 may have an approximately rectangular hexahedral shape in which faces facing each other are open. The upper body 20 may be detachably coupled or connected to the lower body 10. The upper body 20 may be combined in a way that fits into the lower body 10 like a lid, and can be separated from the lower body 10. The lower body 10 and the upper body 20 may each be formed of a foamed resin such as Styrofoam. For example, the lower body 10 and the upper body 20 may be formed by foam molding a raw material resin in a mold. The lower body 10 and the upper body 20 may include, but are not limited to, expanded polystyrene (EPS), expanded polypropylene (EPP), and the like within the spirit and the scope of the disclosure.

The lower body 10 may include a bottom portion 11 and a lower wall portion 12 extending upwardly from the bottom portion 11. The bottom portion 11 and the lower wall portion 12 may be integral with each other. A space defined by the bottom portion 11 and the lower wall portion 12 may form a part of the inner space of the packaging box 1 (for example, a lower space).

Isolation portions 111 may be formed in the bottom portion 11. The isolation portions 111 may be formed at an interval in the second direction (y). The isolation portions 111 may be formed to be spaced apart in the first direction (x), and may be formed in columns. The isolation portions 111 may be continuously formed in the first direction (x). The isolation portions 111 may protrude upward from the bottom portion 11. Slots 112 (or referred to as support grooves) into which the lower edge of the display device 2 is inserted may be formed between the isolation portions 111 adjacent in the second direction (y). The isolation portions 111 may isolate the display device 2 accommodated adjacently while supporting the lower edge of the display device 2. The isolation portions 111 may be elongated in a direction approximately parallel to the first direction (x). The isolation portions 111 adjacent in the first direction (x) may draw a curved line. In case that the display device 2 is a curved display device, the display device 2 is curved as a whole, and thus the isolation portions 111 and the slots 112 may be formed to conform to the curved shape of the display device 2.

A pad 31 may be positioned on the bottom portion 11. The pad 31 may be positioned in a region where the isolation portions 111 are not formed. In case that the display device 2 is loaded in the packaging box 1, the lower edge of the display device 2 may contact the pad 31. The pad 31 may cushion an impact that can be applied to a bottom edge of the display device 2 and elastically limit the motion of the display device 2. The pad 31 may be positioned between the isolation portions 111 and the lower wall portion 12 (by way of example, a first lower wall portion 12*a* or a second lower wall portion 12*b*) in the first direction (x). The pad 31 may be positioned between columns of adjacent isolation portions 111 in the first direction (x). The pad 31 may be fixedly fixed to, for example, attached to the bottom portion 11. The pad 31 may be formed of a foamed resin such as expanded polyethylene (EPE) or EVA foam, but is not limited thereto. The pad 31 may have a thickness of about 5 mm or more, for example in a range of about 5 mm to about 20 mm. For example, the pad 31 may have a thickness of about 10 mm.

The lower wall portion 12 may include a first lower wall portion 12*a* and a second lower wall portion 12*b* that are parallel to each other, while facing each other, and a third lower wall portion 12*c* and a fourth lower wall portion 12*d* that are parallel to each other while facing each other. The first lower wall portion 12*a* and the second lower wall portion 12*b* may be parallel to the y-z plane, and the third lower wall portion 12*c* and the fourth lower wall portion 12*d* may be parallel to the x-z plane. A width of the third lower wall portion 12*c* and the fourth lower wall portion 12*d* may be wider than a width of the first lower wall portion 12*a* and the second lower wall portion 12*b*, but may be substantially equivalent, or vice versa. The width of the first to fourth lower wall portions 12*a* to 12*d* may be variously changed according to a width and quantity of the loaded display device 2. The first lower wall portion 12*a* and the second lower wall portion 12*b* may be thicker than the third lower wall portion 12*c* and the fourth lower wall portion 12*d*. In case that viewed in a plan view, the first to fourth lower wall portions 12*a* to 12*d* may have an approximately rectangular shape.

In an inner surface of the first lower wall portion 12*a* and the second lower wall portion 12*b*, grooves 121 into which the left and right edge portions of the display device 2 can be fitted may be formed at intervals. The grooves 121 may have a shape recessed from the inner surface to the outer surface of the first and second lower wall portions 12*a* and 12*b*. The grooves 121 formed in the first lower wall portion 12*a* and the grooves 121 formed in the second lower wall portion 12*b* may be symmetric with respect to a central axis parallel to the second direction (y). The grooves 121 may be formed over the entire height of the first lower wall portion 12*a* and the second lower wall portion 12*b*. In other words, the grooves 121 may be formed to penetrate the first lower wall portion 12*a* and the second lower wall portion 12*b* in the third direction (z). The grooves 121 may be formed in a direction inclined with respect to the first direction (x). In case that the display device 2 is a curved display device, the display device 2 is curved as a whole and thus the groove 121 may be formed to match the curved shape of the display device 2. Unlike the drawings, the grooves 121 may be formed in a direction parallel to the first direction (x).

A rib 122 may be formed between the grooves 121 on the inner surface of the first lower wall portion 12*a* and the second lower wall portion 12*b*. The ribs 122 may protrude approximately in a direction parallel to the first direction (x). The ribs 122 may be connected to the bottom portion 11. The ribs 122 may isolate the display devices 2 that are stacked adjacently while supporting the left and right edges of the display device 2. In the inner surface of the first lower wall portion 12*a* and second lower wall portion 12*b*, the ribs 122 may be defined by the grooves 121, and conversely, the grooves 121 may be defined by the ribs 122.

The upper body 20 may have a structure similar to that of the lower body 10 as a whole. The upper body 20 may include a cover portion 21 and an upper wall portion 22 extending downwardly from the cover portion 21. The cover portion 21 and the upper wall portion 22 may be integral with each other. A space defined by the cover portion 21 and the upper wall portion 22 may form a part (for example, an upper space) of the inner space of the packaging box 1.

The isolation portions 211 may be formed in the cover portion 21. The isolation portions 211 may be formed to correspond to the isolation portions 111 formed in the bottom portion 11. By way of example, the isolation portions 211 may be formed at an interval in the second direction (y). The isolation portions 211 may be formed to be spaced apart in the first direction (x), and may be formed in columns. The isolation portions 211 may be continuously formed in the first direction (x). The isolation portions 211 may protrude downward from the cover portion 21. Slots 212 into which the upper edge of the display device 2 is inserted may be formed between the isolation portions 211 adjacent in the second direction (y). The isolation portions 211 may isolate the display device 2 accommodated adjacently while supporting the upper edge of the display device 2. The isolation portions 211 may extend in a direction approximately parallel to the first direction (x). The isolation portions 211 adjacent to each other in the first direction (x) may draw a curved line. In case that the display device 2 is a curved display device, the display device 2 is curved as a whole and thus the isolation portions 211 and the slots 212 may be formed to conform to the curved shape of display device 2.

A pad 32 may be positioned on the cover portion 21. The pad 32 may be positioned in a region where isolation portions 211 are not formed. In case that the display device 2 is loaded in the packaging box 1, the top edge of the display device 2 may contact the pad 32. The pad 32 may cushion an impact that can be applied to the top edge of the display device 2 and elastically limit the motion of the display device 2. The pad 32 may be positioned between the isolation portions 211 and the upper wall portion 22, by way of example, a first upper wall portion 22*a* or a second upper wall portion 22*b* in the first direction (x). The pad 32 may be positioned between columns of adjacent isolation portions 211 in the first direction (x). The pad 32 may be fixed to, for example, attached to the cover portion 21. The pad 32 may be formed of a foamed resin such as expanded polyethylene (EPE), EVA foam, or an elastic material such as rubber, but is not limited thereto. The pad 32 may have a thickness of about 5 mm or more, for example in a range of about 5 mm to about 20 mm. For example, the pad 32 may have a thickness of about 10 mm.

The upper wall portion 22 may include a first upper wall portion 22*a* and a second upper wall portion 22*b* that are parallel to each other while facing each other, and a third upper wall portion 22*c* and a fourth upper wall portion 22*d* that are parallel to each other while facing each other. The first upper wall portion 22*a* and the second upper wall portion 22*b* may be parallel to the y-z plane, and the third upper wall portion 22*c* and the fourth upper wall portion 22*d* may be parallel to the x-z plane. Widths of the third upper wall portion 22*c* and the fourth upper wall portion 22*d* may be wider than widths of the first upper wall portion 22*a* and the second upper wall portion 22*b*, but may be substantially equivalent, or vice versa. The first upper wall portion 22*a* and the second upper wall portion 22*b* may be thicker than the third upper wall portion 22*c* and the fourth upper wall portion 22*d*. In a plan view, the first to fourth upper wall portions 22*a* to 22*d* may have an approximately rectangular shape. The first upper wall portion 22*a*, the second upper wall portion 22*b*, the third upper wall portion 22*c*, and the fourth upper wall portion 22*d* may correspond to the first lower wall portion 12*a*, the second lower wall portion 12*b*, the third lower wall portion 12*c*, and the fourth lower wall portion 12*d*, respectively. The first upper wall portion 22*a*, the second upper wall portion 22*b*, the third upper wall portion 22*c*, and the fourth upper wall portion 22*d* are combined with the first lower wall portion 12*a*, the second lower wall portion 12*b*, the third lower wall portion 12*c*, and the fourth lower wall portion 12*d*, respectively. Thus, a wall portion of the packaging box 1 can be formed.

In inner surfaces of the first upper wall portion 22*a* and the second upper wall portion 22*b*, grooves 221 into which the left and right edge portions of the display device 2 can be fitted may be formed at intervals. The grooves 221 may be formed to correspond to the grooves 121 formed in the first lower wall portion 12*a* and the second lower wall portion 12*b*. In a state in which the upper body 20 is coupled or connected to the lower body 10, the grooves 221 may be aligned and connected to the grooves 121 in the third direction (z). Accordingly, in case that the display device 2 is loaded in the packaging box 1, a part (about the lower half) of the both edge portions of the display device 2 may be fitted into the grooves 121, and a part (about the upper half) may be fitted into the grooves 221.

The grooves 221 formed in the first upper wall portion 22*a* and the grooves 221 formed in the second upper wall portion 22*b* may be symmetrical with respect to a central axis parallel to the second direction (y). The grooves 221 may be formed over the entire height of the first upper wall portion 22*a* and the second upper wall portion 22*b*. In other words, the grooves 221 may be formed to pass through the first upper wall portion 22*a* and the second upper wall portion 22*b* in the third direction (z). The groove 121 and the groove 221 corresponding thereto may penetrate through the first lower wall portion 12*a* and the first upper wall portion 22*a* in the third direction (z) or through the second lower wall portion 12*b* and the second upper wall portion 22*b*. The grooves 221 may be formed in a direction inclined with respect to the first direction (x). In case that the display device 2 is a curved display device, the display device 2 is curved as a whole, and thus the groove 221 may be formed to match the curved shape of the display device 2. Unlike the drawing, the grooves 221 may be formed in a direction parallel to the first direction (x).

A rib 222 may be formed between the grooves 221 on the inner surfaces of the first upper wall portion 22*a* and the second upper wall portion 22*b*. The ribs 222 may protrude approximately in a direction parallel to the first direction (x). The ribs 222 may be connected to the cover portion 21. The ribs 222 may be formed to correspond to the ribs 122 formed in the first lower wall portion 12*a* and the second lower wall portion 12*b* of the lower body 10. In the state where upper body 20 is combined with lower body 10, the ribs 222 may be aligned and connected to the ribs 122 in the third direction (z). The ribs 222 may isolate the display device 2 accommodated adjacently while supporting the left and right edges of the display device 2. In the inner surfaces of the first upper wall portion 22*a* and the second upper wall portion 22*b*, the ribs 222 may be defined by the grooves 221, and conversely, the grooves 221 may be defined by the ribs 222.

In case that the display device 2 is loaded in the packaging box 1, the lower edge of the four edge portions of the display device 2 may be fit into the slot 112 of the bottom portion 11 of the lower body 10, the upper edge may be fit into in the slot 212 of the cover portion 21 of the upper body 20, the left edge may fit into the groove 121 of the first lower wall portion 12*a* and the groove 221 of the first upper wall portion 22*a*, and the right edge may fit into the groove 121 of the second lower wall portion 12*b* and the groove 221 of the second upper wall portion 22. Accordingly, the display device 2 may be transported in a state in which the four edges are restrained and fixed in the packaging box 1. However, in case that the display device 2 is transported, it may be shaken in the packaging box 1 due to vibration of the vehicle. In case that the display device 2 moves up and down, a side seal formed around the edge of the display panel 2*a* constituting the display device 2 may be rubbed against the inner surface of the packaging box 1 and the side seal may be broken. Accordingly, the appearance quality of the display device 2 is deteriorated, and light leakage may occur at the edge of the display panel 2*a*. The edge of the display panel 2*a* may be damaged or the inner surface of the packaging box 1 may be broken. In order to prevent such a problem from occurring, openings 230 connected to or abutted with the grooves 221 are formed in the upper body 20. Hereinafter, features related to the openings 230 will be described in detail with reference to drawings showing a cross-section structure of packaging box 1.

Figure 5:
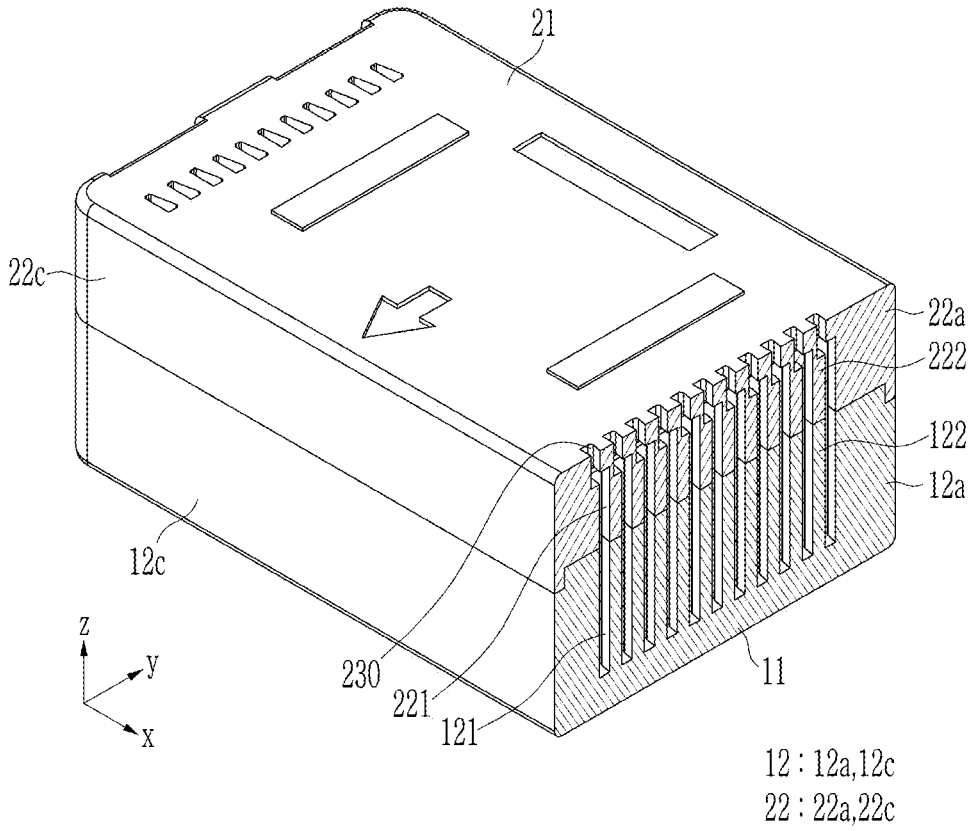
FIG. 5 is a vertical schematic cross-sectional perspective view of FIG. 1, taken along the line A-A'.
Figure 6:
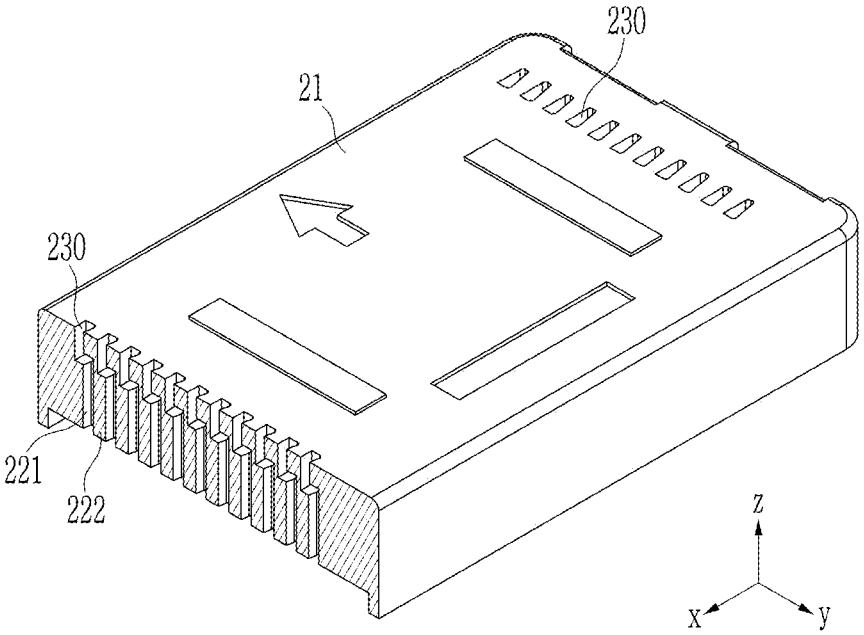
FIG. 6 is a schematic perspective view of the upper body of the display device packaging box shown in FIG. 5.
Figure 7:
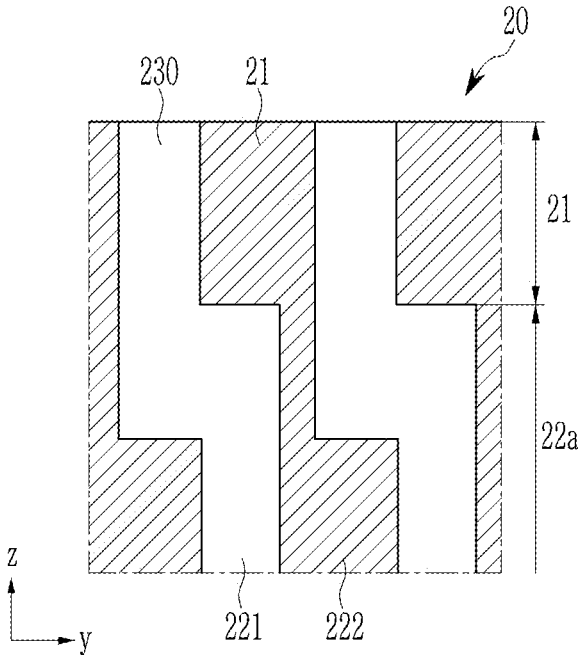
FIG. 7 is a partially enlarged view of the display device packaging box shown in FIG. 5.
Figure 8:
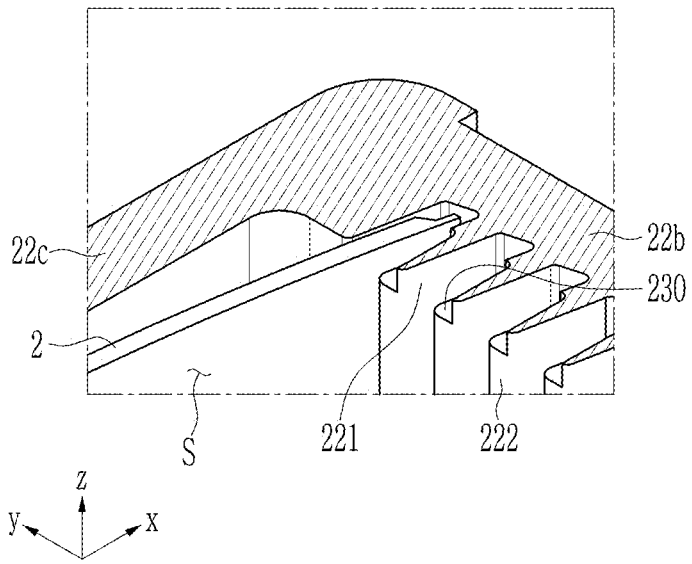
FIG. 8 is a horizontal schematic cross-sectional perspective view of the display device packaging box according to an embodiment.
Figure 9:
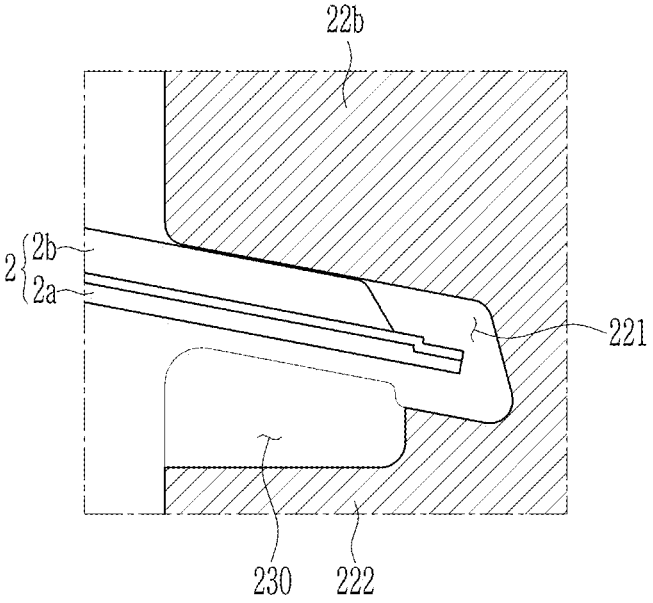
FIG. 9 is a horizontal schematic cross-sectional view of the display device packaging box according to an embodiment.

FIG. 5 is a vertical schematic cross-sectional perspective view of FIG. 1, taken along the line A-A', FIG. 6 is a schematic perspective view of the upper body of the display device packaging box shown in FIG. 5, and FIG. 7 is a partially enlarged view of the display device packaging box shown in FIG. 5. FIG. 8 is a horizontal schematic cross-sectional perspective view of the display device packaging box according to an embodiment, and FIG. 9 is a horizontal schematic cross-sectional view of the display device packaging box according to an embodiment.

FIG. 5 illustrates a vertically cut cross-section of a portion where the opening 230 are formed in the display device packaging box 1 according to an embodiment. FIG. 6 illustrates the upper body 20 in FIG. 5. FIG. 7 is an enlarged view of an area where the openings 230 and the grooves 221 meet. FIG. 8 illustrates a horizontally cut cross-section of a portion where the second upper wall portion 22*b* and the third upper wall portion 22*c* of the upper body 20 meet. FIG. 9 is an enlarged schematic plan view of a part of the horizontal cross-section shown in FIG. 8. Although FIG. 5 to FIG. 7 illustrate the vertically cut cross-section of the first upper wall portion 22*a*, the cross-sectional structure of the second upper wall portion 22*b* may be substantially equivalent to the drawing. Although FIG. 8 and FIG. 9 illustrate horizontally cut second upper wall portion 22*b*, the cross-sectional structure of the first upper wall portion 22*a* may be equivalent to the drawing. Accordingly, the description of the first upper wall portion 22*a* may be equally applied to the second upper wall portion 22*b*, and the description of the second upper wall portion 22*b* may be equally applied to the first upper wall portion 22*a*.

Referring to FIG. 5 to FIG. 9, the grooves 121 formed in the first lower wall portion 12*a* may be connected to the grooves 121 formed in the first upper wall portion 22*a* in the third direction (z). The edge of the display device 2 is inserted into these grooves 121, and thus the display device 2 can be accommodated and loaded in a position in the packaging box 1 and loaded. The ribs 122 of the first lower wall portion 12*a* may be connected to the ribs 222 of the first upper wall portion 22*a* in the third direction (z). Upper surfaces of the ribs 122 may be in contact with lower surfaces of the ribs 222.

The openings 230 respectively connected to the grooves 121 of the first upper wall portion 22*a* may be formed in the cover portion 21. The openings 230 may be formed in a line along the second direction (y) at both sides of the cover portion 21 corresponding to the first and second upper wall portions 22*a* and 22*b*. The openings 230 may correspond to the grooves 121 one-to-one. The opening 230 may pass through the cover portion 21 in the third direction (z) and may be formed to extend to an upper end of the first upper wall portion 22*a*. As a result, an upper end of the rib 222 may have a shape in which a portion is removed by the opening 230. Accordingly, the groove 121 and the opening 230 may be connected in the upper end of the first upper wall portion 22*a* as shown in the drawing. For example, the upper end of the groove 121 and the lower end of the opening 230 may be connected to each other, and may be open to each other. The opening 230 may be shifted from the groove 121 in the second direction (y) and in the opposite direction (−y). A portion of the upper body 20 defining a region where the opening 230 and the groove 121 meet may have a step-like shape in a longitudinal cross-section view. The region where the opening 230 and the groove 121 meet may have a shape bent twice. The opening 230 may not overlap the groove 121. The opening 230 may overlap rib 222. Unlike as shown, the opening 230 may include a region overlapping the groove 121.

The display device 2 may be fitted into the groove 121 such that the screen S may face the opening 230 (for example, facing the second direction (y) and the opposite direction (−y)). In case that the packaging box 1 is transported by a truck or a train, the display device 2 inserted into the groove 121 may be moved repeatedly by vibration. The opening 230 may form an escape space that prevents the upper edge of the display device 2 from contacting the inner surface of the upper body 20. A portion of the upper body 20 defining the opening 230 may not contact the display device 2.

Figure 10:
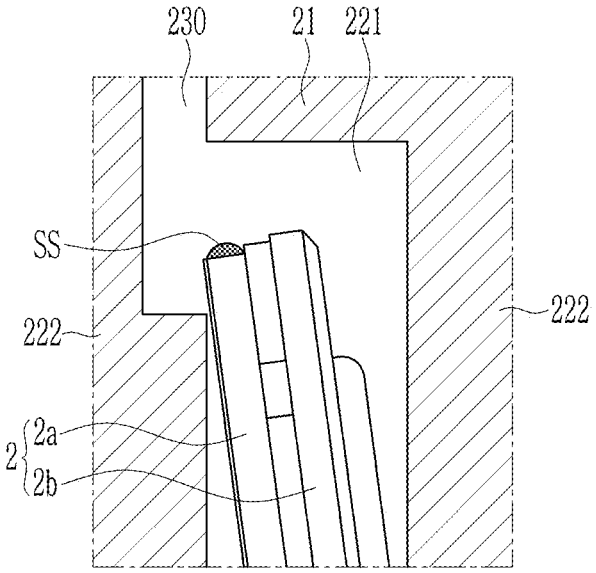
FIG. 10 shows a state of the display device in the display device packaging box according to an embodiment.
Figure 11:
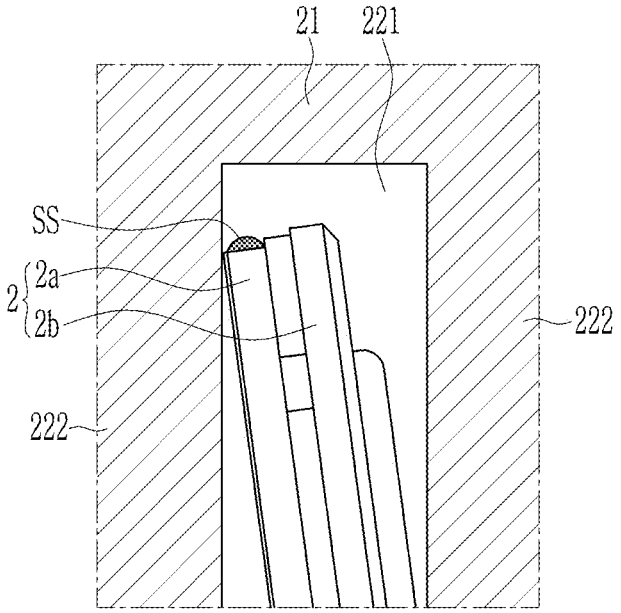
FIG. 11 shows a state of a display device in packing box according to a comparative example.
Figure 12:
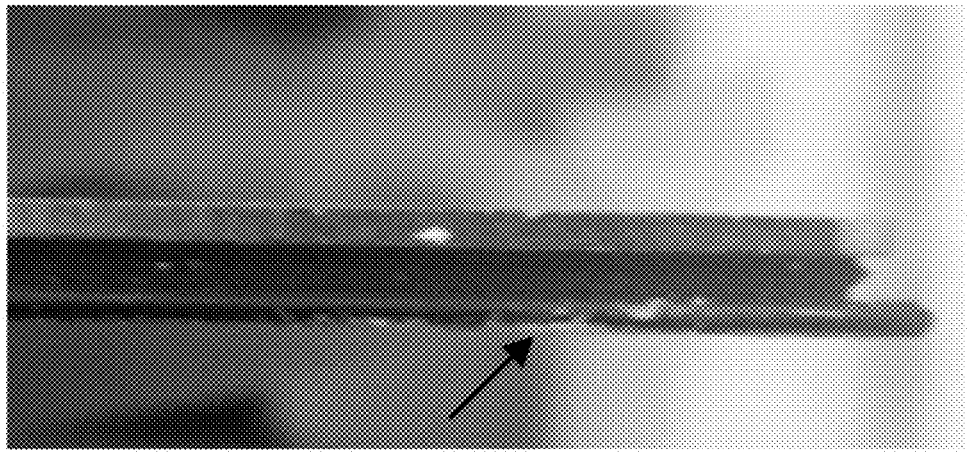
FIG. 12 is a photograph showing the occurrence of cracking of the side seal of the display device.

FIG. 10 shows a state of the display device in the display device packaging box according to an embodiment, and FIG. 11 shows a state of a display device in packing box according to a comparative example. FIG. 12 is a photograph showing the occurrence of cracking of the side seal of the display device.

Referring to FIG. 10, the display device 2 may be positioned in a region where the opening 230 and the groove 221 are connected to the top edge in a state in which the display device 2 is loaded in the packaging box 1. Although the display device 2 moves (by way of example, up and down), a side seal SS formed on the upper edge or edge of the display device 2 may not come into contact with any part of the packaging box 1 by an escape space formed by the opening 230. The side seal SS may be formed by coating and curing a colored resin on the side surface of the display panel 2*a* for light leakage prevention, pollution prevention, moisture permeability enhancement, adhesion, and the like of the display panel 2*a*. Due to the material characteristics, the side seal SS may be vulnerable to friction. Although the display device 2 moves within the packaging box 1, the side seal SS does not come into contact with the packaging box 1, and thus the side seal SS of the display device 2 can be prevented from being broken or damaged due to impact or vibration applied during transportation of the display device 2. It is possible to prevent the packaging box 1 from being crushed by scratching the inner surface of the packaging box 1 by the upper edge of the display device 2.

Referring to FIG. 11, an example in which the opening 230 connected to the groove 221 is not formed in the packaging box 1 is shown. Since there is no escape space that can be provided by the opening 230, a top edge portion or the side seal SS of the display device 2 may be in contact with the rib 222. Therefore, in case that the display device 2 moves, the top edge or side seal SS of display device 2 rubs with the rib 222, and the side seal SS may be broken. The cracking of the side seal SS can be seen in the part marked with an arrow in the photograph of FIG. 12. The cracking of the side seal SS not only deteriorates the external quality of the display device 2, but also causes light leakage on the side of the display panel 2*a*. The cracked pieces may be attached to the display device 2 as foreign particles. However, according to an embodiment, it is possible to prevent breakage of the side seals SS and defects resulting therefrom by the escape space that can prevent friction of the side seals SS.

Figure 13:
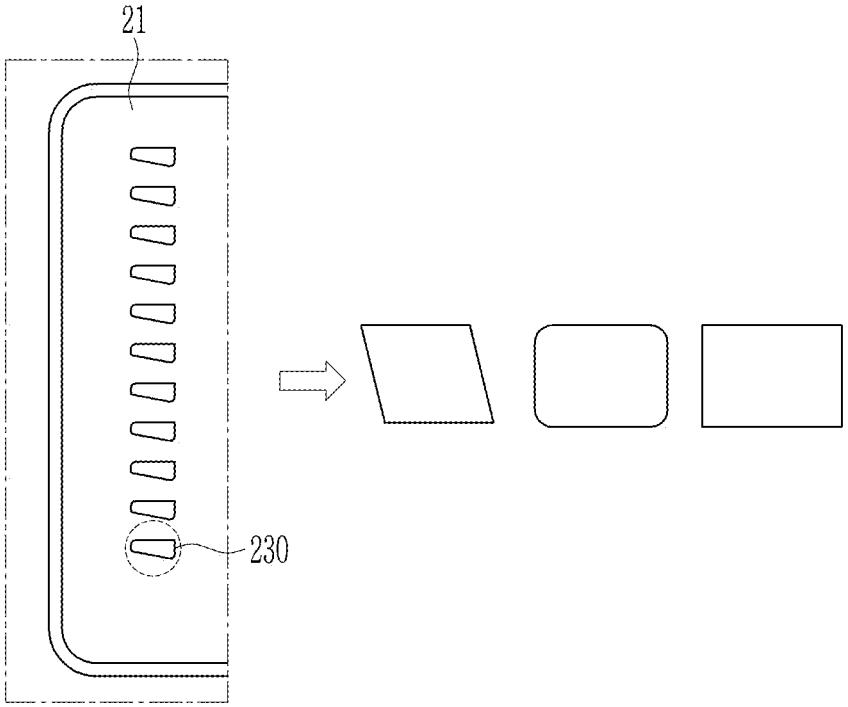
FIG. 13 is a top schematic plan view of the upper body of the display device packaging box according to an embodiment.

FIG. 13 is a top schematic plan view of the upper body of the display device packaging box according to an embodiment.

Referring to FIG. 13, the opening 230 formed through the cover portion 21 of the upper body 20 and connected to the groove 221 may have a substantially trapezoid planar shape. As described above, in case that the display device 2 is a curved display device, the display device 2 is curved as a whole, and accordingly the groove 221 may be formed to match the curved shape of display device 2. The opening 230 of approximately trapezoid planar shape may fit the shape of the groove 121 formed in a direction inclined with respect to the first direction (x). Considering the mold for forming the opening 230, the length of the shortest side of the opening 230 may be about 8 mm or more. For example, the opening 230 may have a trapezoid planar shape having an upper side of about 8 mm and a height of about 27 mm, but is not limited thereto, and may be formed in various sizes in consideration of the dimensions of the groove 221 and the rib 222. The opening 230 may have various planar shapes in addition to the trapezoid. For example, the opening 230 may be formed to have a flat shape, such as a flat quadrilateral, a rounded rectangular shape, or a rectangular shape, as shown.

Figure 14:
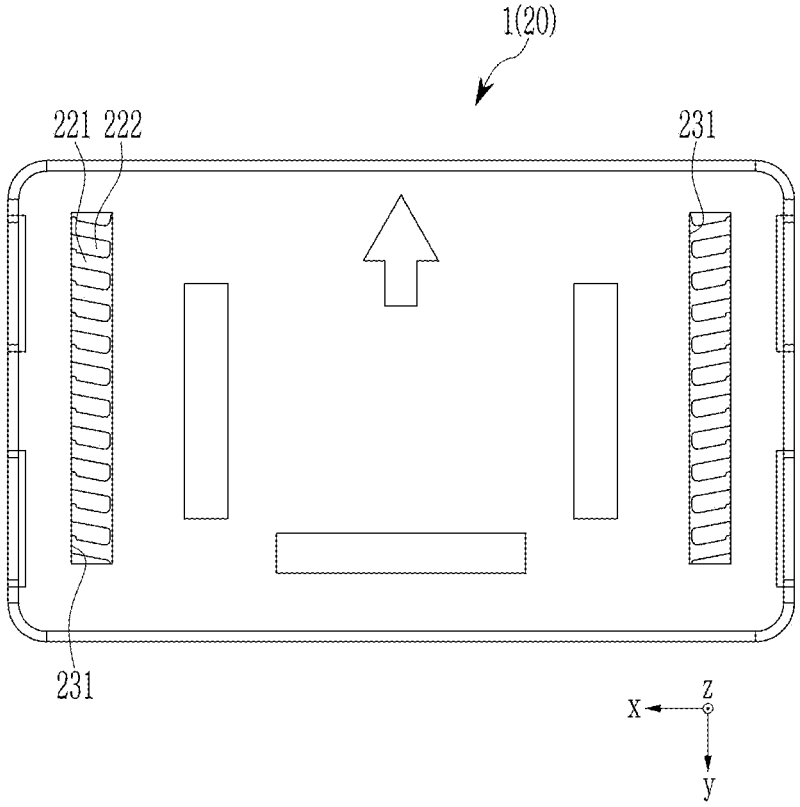
FIG. 14 is a top schematic plan view of the display device packaging box according to an embodiment.
Figure 15:
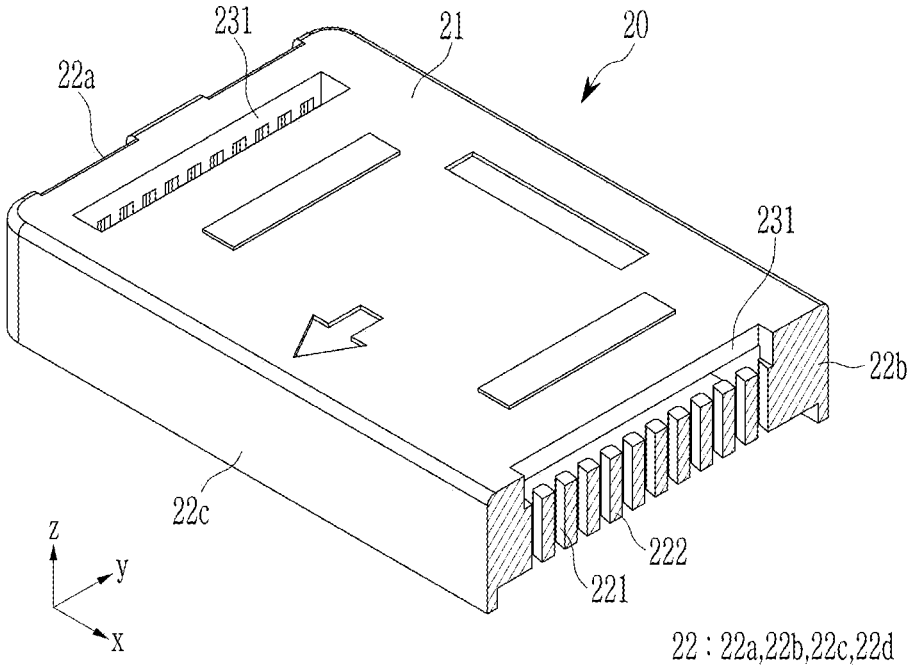
FIG. 15 is a vertical schematic cross-sectional perspective view of the display device shown in FIG. 13.

FIG. 14 is a top schematic plan view of the display device packaging box according to an embodiment, and FIG. 15 is a vertical schematic cross-sectional perspective view of the display device shown in FIG. 13.

Referring to FIG. 14 and FIG. 15, unlike the above-described embodiment in which one opening 230 connected to one groove 221 is formed, in an embodiment, one opening 231 is formed for grooves 221. The opening 231 extended in the second direction (y) may be connected to the grooves 221 formed in the first upper wall portion 22*a* or the second upper wall portion 22*b*. The opening 231 may pass through the cover portion 21 in the third direction (z) and may be formed to extend to an upper end of the first upper wall portion 22*a* or the second upper wall portion 22*b*. The upper end of the ribs 222 may have a shape removed by the opening 231. Accordingly, the opening 231 may overlap the ribs 222, and the ribs 222 may not be connected to the cover portion 21.

Similar to the above-described embodiment, a packaging box 1 may provide an escape space by the opening 231 connected to the grooves 221, and may prevent breakage of a side seals SS of a display panel 2*a* and defects resulting therefrom. However, since the region in which the opening 231 is formed, for example, the region removed from the cover portion 21 is wide, the rigidity of the cover portion 21 may deteriorate, and thus the possibility of damage during impact may increase.

While this disclosure has been described in connection with what is considered to be practical embodiments, it is to be understood that the disclosure is not limited to the disclosed embodiments. On the contrary, it is intended to cover various modifications and equivalent arrangements included within the spirit and scope of the appended claims.

What is claimed is:

1. A packing box comprising:

a lower body including a bottom portion and a lower wall portion extending upward from the bottom portion; and an upper body including a cover portion and an upper wall portion extending downward from the cover portion and defining an inner space with the lower body in a case that the upper body is combined with the lower body, wherein the upper wall portion comprises at least one groove the cover portion comprises an at least one opening abutted with the at least one groove, and a region in which the opening meets the at least one groove has a twice bent shape or a step-like shape.

2. The packing box of claim 1, wherein the at least one opening penetrates the cover portion and extends up to the upper wall portion of the upper body.

3. The packing box of claim 1, wherein a lower end portion of the at least one opening abuts an upper end portion of the at least one groove.

4. The packing box of claim 1, wherein
the at least one opening is shifted in a horizontal direction from the at least one groove.

5. The packing box of claim 4, wherein
the at least one opening does not overlap the at least one groove in plan view.

6. The packing box of claim 4, wherein
the upper wall portion comprises a rib adjacent to the at least one groove, and
the at least one opening overlaps the rib in plan view.

7. The packing box of claim 1, wherein
the upper wall portion comprises a first upper wall portion and a second upper wall portion facing each other,
the at least one groove includes grooves formed in inner surfaces of the first upper wall portion and second upper wall portion, and
the at least one opening includes openings corresponding to the grooves.

8. The packing box of claim 7, wherein
the openings are formed in a line on both sides of the cover portion corresponding to the first upper wall portion and the second upper wall portion.

9. The packing box of claim 1, wherein
the at least one opening has a substantially trapezoidal planar shape.

10. A packing box comprising:
a lower body including a bottom portion and a lower wall portion extending upward from the bottom portion;
an upper body including a cover portion and an upper wall portion extending downward from the cover portion and defining an inner space with the lower body in a case that the upper body is combined with the lower body, wherein
the upper wall portion comprises at least one groove,
the cover portion comprises an at least one opening abutted with the at least one groove, and
the packing box further comprising:
isolation portions protruding downward from the cover portion and defining a slot; and
a pad disposed between the upper wall portion and the isolation portions and contacting an edge portion of a display device in a case where an edge portion of the display device is inserted into the slot.

11. The packing box of claim 10, wherein
the isolation portions are formed in rows, and
the packing box further comprising a second pad disposed between adjacent rows of isolation portions and contacting the edge portion of the display device.

12. The packing box of claim 1, wherein
a display device is configured to be inserted into the at least one groove such that a screen of the display device faces the at least one opening.

13. The packing box of claim 1, wherein
the at least one groove includes grooves formed in plural on an inner surface of the upper wall portion, and
the at least one opening includes openings formed corresponding to the grooves.

14. A packing box comprising:
a lower body; and
an upper body detachably connected with the lower body, wherein
the upper body includes a cover portion and an upper wall portion connected to the cover portion,
the upper wall portion includes a first upper wall portion and a second upper wall portion facing each other,
the first upper wall portion and the second upper wall portion are formed with grooves
openings respectively abutted with the grooves are formed in the cover portion of the upper body, and
regions in which the openings meet the grooves have a twice bent shape or a step-like shape.

15. The packing box of claim 14, wherein
the openings extend through the cover portion to the first upper wall portion and to the second upper wall portion.

16. The packing box of claim 14, wherein
upper ends of the grooves and lower ends of the openings are opened to each other.

17. The packing box of claim 14, wherein
the openings are shifted in a horizontal direction from the grooves.

18. The packing box of claim 17, wherein
the first upper wall portion and the second upper wall portion are formed with ribs disposed between the grooves, and
the openings overlap the ribs in plan view and do not overlap the grooves in plan view.

19. The packing box of claim 14, wherein
the openings are formed in a line on both sides of the cover portion corresponding to the first upper wall portion and the second upper wall portion.

20. The packing box of claim 14, further comprising:
isolation portions protruding downward from the cover portion and defining a slot into which an edge portion of a display device is configured to be inserted; and
a pad disposed between the upper wall portion and the isolation portions and contacting the edge portion of the display device in a case in which the edge portion of the display device is inserted into the slot.

* * * * *